US006998557B2

(12) United States Patent
McGuffin-Noll

(10) Patent No.: US 6,998,557 B2
(45) Date of Patent: Feb. 14, 2006

(54) POWER DRIVEN FOOD MACHINE AND RELATED MULTI-ACTION SWITCH ASSEMBLY

(75) Inventor: Douglas J. McGuffin-Noll, Savannah, GA (US)

(73) Assignee: Premark FEG L.L.C., Wilmington, DE (US)

( * ) Notice: Subject to any disclaimer, the term of this patent is extended or adjusted under 35 U.S.C. 154(b) by 0 days.

(21) Appl. No.: 10/927,847

(22) Filed: Aug. 27, 2004

(65) Prior Publication Data

US 2005/0045455 A1 Mar. 3, 2005

Related U.S. Application Data

(60) Provisional application No. 60/499,117, filed on Aug. 29, 2003.

(51) Int. Cl.
*H01H 15/24* (2006.01)

(52) U.S. Cl. ..... 200/538; 200/50.32; 200/519

(58) Field of Classification Search ..... 200/17 R, 200/18, 50.32, 50.33, 50.35, 50.36, 519, 200/537, 538, 542, 573, 574
See application file for complete search history.

(56) References Cited

U.S. PATENT DOCUMENTS

| | | | | |
|---|---|---|---|---|
| 3,215,806 | A * | 11/1965 | Arnold et al. | 200/313 |
| 4,077,161 | A | 3/1978 | Wyle et al. | |
| 4,282,414 | A * | 8/1981 | Johnston et al. | 200/519 |
| 4,540,864 | A | 9/1985 | Krasser et al. | |
| 4,602,137 | A | 7/1986 | Kawasaki | |
| 5,408,058 | A | 4/1995 | Homik et al. | |
| 5,408,061 | A * | 4/1995 | Martin | 200/538 |
| 5,508,480 | A * | 4/1996 | Quinlan | 200/16 A |
| 2003/0079589 | A1 | 5/2003 | Kovacs | |

OTHER PUBLICATIONS

Prior Art Switch Assembly #1—4 Photographs.
Prior Art Switch Assembly #2—3 Photographs.

* cited by examiner

*Primary Examiner*—Michael A. Friedhofer
(74) *Attorney, Agent, or Firm*—Thompson Hine LLP

(57) ABSTRACT

A power driven machine such as a food product slicer, band saw apparatus or food mixer, includes a multi-action switch assembly with first and second switch units and a switch actuator for selectively actuating the first and second switch units in a manner to trigger certain control functions of the machine.

23 Claims, 6 Drawing Sheets

POWER DRIVEN FOOD MACHINE AND RELATED MULTI-ACTION SWITCH ASSEMBLY

CROSS REFERENCE TO RELATED APPLICATIONS

This application claims priority to U.S. Provisional Application 60/499,117, filed Aug. 29, 2003.

TECHNICAL FIELD

The present invention relates generally to food machines such as slicers, mixers and band saws, as well as other machines utilizing multi-action switches, such as switches intended to provide start, pause and stop functions for the machines, and, more particularly, to a food machine having a multi-action switch assembly with two switch units.

BACKGROUND

Various types of machinery utilize switches that provide multiple functions. For example, in the field of commercial food equipment, in the past food slicers have utilized a switch mechanism in which a push/pull knob is connected to a toggle switch. The toggle switch includes a single actuator that has a normal center position and two actuation positions. The actuator is associated with two internal contact subassemblies, one of which is normally closed and the other of which is normally open when the actuator is in its normal center position. When the actuator is moved in one direction into a first of the actuation positions, the normally open contact subassembly is temporarily closed, and the toggle switch has a built in momentary action via a cam or spring to return the actuator to its normal center position and thus return the normally open contact subassembly to its open position. When the actuator is moved in the opposite direction toward the second actuation position, the normally closed contact subassembly is opened, and the actuator remains fixed in this second actuation position, maintaining the normally closed contact subassembly in an open condition. In practice, a push/pull knob is connected with the actuator such that a pulling action of the knob moves the actuator toward the first actuation position and a pushing action of the knob moves the actuator toward the second actuation position. The toggle switch is connected in the control circuit of the food slicer such that an initial pulling action of the knob starts the food slicer and a subsequent pulling action of the knob pauses the food slicer. Any time the knob is pushed inward, operation of the food slicer is stopped. Reference is made to FIGS. 9 and 10 of U.S. Patent Publication Ser. No. 2003/0079589 A1 showing use of the toggle switch in a food product slicer. The above-described switch system has also been used in other types of commercial food equipment.

While the foregoing switch system has performed well, improvements are continually sought.

SUMMARY

In one aspect, a power driven machine includes at least one energizable motor and a control system for controlling motor operation. The control system has an associated multi-action switch assembly that includes a first switch unit connected in the control system with an internal contact biased into a first condition. The first switch unit includes an integrated contact actuator biased into a normal position and effective upon movement to transition the internal contact of the first switch unit to a second condition where temporary transition of the internal contact of the first switch unit to the second condition controls a start operation of the motor. A second switch unit is connected in the control system with an internal contact biased into a first condition. The second switch unit includes an integrated contact actuator biased into a normal position and effective upon movement to transition the internal contact of the second switch unit to a second condition where temporary transition of the internal contact of the second switch unit to the second condition controls a stop operation of the motor. A resilient switch actuator is included having a normal position in which the contact actuator of the first switch unit is in its normal position and the contact actuator of the second switch unit is in its normal position. When a first force is applied to bend the switch actuator in a first direction, the switch actuator moves the contact actuator of the first switch unit out of its normal position. Upon removal of the first force, the switch actuator recovers toward its normal position and the contact actuator of the first switch unit returns to its normal position. When a second force is applied to bend the switch actuator in a second direction, the switch actuator moves the contact actuator of the second switch unit out of its normal position. Upon removal of the second force, the switch actuator recovers toward its normal position and the contact actuator of the second switch unit returns to its normal position.

In another aspect, a power driven machine includes at least one energizable motor and a control system for controlling motor operation and having an associated a multi-action switch assembly. The multi-action switch assembly includes a first switch unit connected in the control system with an internal contact in a first condition, and including an integrated contact actuator effective upon movement to transition the internal contact of the first switch unit to a second condition. Transition of the internal contact of the first switch unit to the second condition controls a start operation of the motor. A second switch unit is connected in the control system with an internal contact in a first condition, and includes an integrated contact actuator effective upon movement to transition the internal contact of the second switch unit to a second condition. Transition of the internal contact of the second switch unit to the second condition controls a stop operation of the motor. A switch actuator includes a pivot member mounted for pivot about a pivot axis, the pivot member having a normal position relative to the pivot axis in which the contact actuator of the first switch unit is in an established position, the internal contact of the first switch unit is in its first condition, the contact actuator of the second switch unit is in an established position, and the internal contact of the second switch unit is in its first condition. When a first pivoting force is applied to move the pivot member in a first direction a first portion of the pivot member moves the contact actuator of the first switch unit out of its established position to transition the internal contact of the first switch unit to its second condition. When a second pivoting force is applied to move the pivot member in a second direction a second portion of the pivot member moves the contact actuator of the second switch unit out of its established position to transition the internal contact of the second switch unit to its second condition.

In yet another aspect, a multi-action switch assembly includes a first switch unit with an internal contact movable between a first condition and a second condition, a second switch unit with an internal movable between a first condition and a second condition and a resilient switch actuator having a normal position in which the internal contact of the first switch unit is in its first condition and the internal contact of the second switch unit is in its first condition. When a first force is applied to bend the switch actuator in a first direction, the switch actuator causes the internal contact of the first switch unit to transition to its second condition. Upon removal of the first force, the switch actuator recovers toward its normal position and the internal contact of the first switch unit returns to its first condition. When a second force is applied to bend the switch actuator in a second direction, the switch actuator causes the internal contact of the second switch unit to transition to its second condition. Upon removal of the second force, the switch actuator recovers toward its normal position and the internal contact of the second switch unit returns to its first condition.

The details of one or more embodiments are set forth in the accompanying drawings and the description below. Other features, objects and advantages will be apparent from the description and drawings, and from the claims.

DETAILED DESCRIPTION

Figure 1:
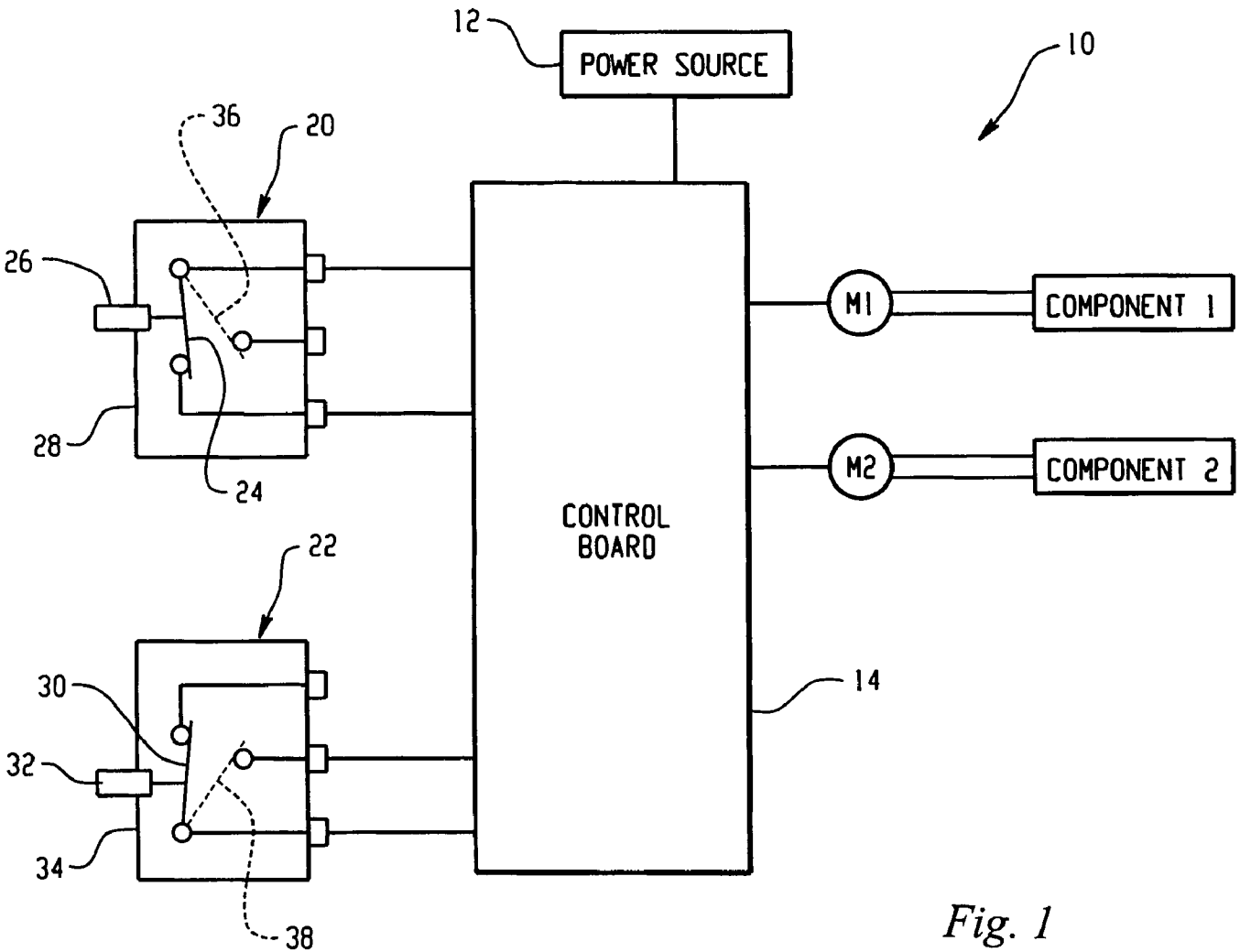
FIG. 1 is schematic diagram of a power driven machine.

Referring to FIG. 1, an exemplary power driven machine 10 is shown in schematic form and includes energizable motors M1 and M2 each connected for moving respective components. A power source 12 is shown connected through a control board 14 for selective energization of the motors. By way of example, machine 10 may be a food product slicer, motor M1 may drive a rotatable slicer knife and motor M2 may drive a carriage that moves food product back and forth past the rotating slicer knife. In another example, machine 10 may be a band saw apparatus, motor M1 may drive a pulley wheel to move a band saw blade, and motor M2 may move a meat conveyor, or in the alternative motor M2 may not be present. In still another example, machine 10 may be a mixer, motor M1 may drive an output shaft that is adapted to receive a mixing implement, and motor M2 may not be present. Machine 10 could represent other types of food machines as well as non-food machines.

The control board 14 is configured to control motors M1 and/or M2 in accordance with two switch units 20 and 22. Switch unit 20 includes a movable internal contact 24 and an associated contact actuator 26 that extends from a housing 28 of the switch unit into the normal position shown. Switch unit 22 includes a movable internal contact 30 and an associated contact actuator 32 that extends from a housing 34 of the switch unit into the normal position shown. In one embodiment, the switch units 20 and 22 are three terminal snap action microswitches (such as the T85 5E4 available from FAIA-Burgess of Switzerland) in which the internal contacts 24 and 30 are formed by leaf-spring type members that are biased into the normal positions shown. Inward movement of the respective contact actuators 26 and 32 (movement from left to right in FIG. 1) causes the contacts 24 and 30 to flip to the respective positions shown by dashed lines 36 and 38, and upon release of the contact actuators 26 and 32 the leaf spring feature of the internal contacts 24 and 30 causes them to move back to their respective normal positions and also causes the contact actuators 26 and 32 to move back to their respective normal positions. Other types of switch units could also be used. In the illustrated embodiment, the switch unit 20 is connected to the control board with internal contact 24 in a normally closed condition, and when flipped the contact 24 moves to an open condition. Switch unit 22 is connected to the control board with internal contact 30 in a normally open condition, and when flipped the contact 30 moves to a closed condition.

In one embodiment, the control board is set up such that: (1) when the motor M1 is de-energized and contact 30 of switch unit 22 is temporarily moved into the closed condition represented by position 38, the control board responsively causes the motor M1 to be energized, (2) when the motor M1 is energized and the contact 30 of switch unit 22 is temporarily moved into the closed condition represented by position 38, the control board responsively causes the motor M1 to be de-energized and (3) when the motor M1 is energized and the contact 24 of switch unit 20 is temporarily moved into the open condition represented by position 36, the control board responsively causes the motor M1 to be de-energized. The difference between control actions (2) and (3) above may be that control action (2) is used as a pause function and control action (3) is used to kill all power to the machine as by opening a main power contact. In the case of a food product slicer such as that described in U.S. Patent Publication No. 2003/0079589 A1, the entire specification of which is incorporated herein by reference, with motor M1 connected to drive the slicer knife and motor M2 selectively connectable to drive the food product carriage, the pause function of control action (2) is active only when the slicer is operating in an automatic mode, where the carriage is power driven by the motor M2 as opposed to a manually moved by an operator. In such cases the pause function of control action (2) causes the food product carriage to move to a certain "home" position prior to de-energizing the motors M1 and M2. In contrast, the control action (3) would immediately de-energize the motors M1 and M2 regardless of the food product carriage position.

Referring now to FIGS. 2–5, one embodiment of a switch actuator for the switch units 20 and 22 is shown. In particular, a pivot member 40, which in one embodiment is formed of a resilient plastic, is mounted to pivot about a pivot axis 42 that may be formed by a post extending from a plate 44. The switch units 20 and 22 are also mounted to the plate 44. The pivot member 40 includes arm 46 extending away from the pivot axis 42 and arm 48 extending away from the pivot axis 42. A portion 50 of arm 46 is positioned near contact actuator 32 and a portion 52 of arm 48 is positioned near contact actuator 26.

When a force is applied to pivot the pivot member 40 about axis 42 in a direction indicated by arrow 54, portion 50 is moved into engagement with and causes contact actuator 32 to move out of its normal position so that the internal contact of switch unit 22 is flipped. In particular, and referring to FIG. 4, the end 56 of arm 46 abuts against the switch unit housing 34 and therefore movement of the end 56 of arm 46 is restricted when the pivot member 40 is pivoted, causing arm 46 to flex as shown so that portion 50 engages contact actuator 32. The flex of arm 46 causes the pivot member 40 to return to its normal position (FIG. 2) when the force applied to pivot the member 40 in direction 54 is released. When member 40 returns to its normal position, switch actuator 32 likewise returns to its normal position and thus the internal contact of switch unit 22 flips back to its normal position.

When a force is applied to pivot the member 40 in the opposite direction indicated by arrow 58, portion 52 of arm 48 is moved into engagement with and causes contact actuator 26 to move out of its normal position so that the internal contact of switch unit 20 is flipped. In particular, and referring to FIG. 5, a stop 60, such as a post the extends from the plate 44, restricts movement of the arm 46 when member 40 is pivoted, causing arm 46 to flex slightly as shown. At the same time, arm 48 moves such that portion 52 engages contact actuator 26 as shown. The flex of arm 46 causes the pivot member 40 to return to its normal position (FIG. 2) when the force applied to pivot the member 40 in direction 58 is released. When member 40 returns to its normal position, switch actuator 26 likewise returns to its normal position and thus the internal contact of switch unit 20 flips back to its normal position.

Figure 2:
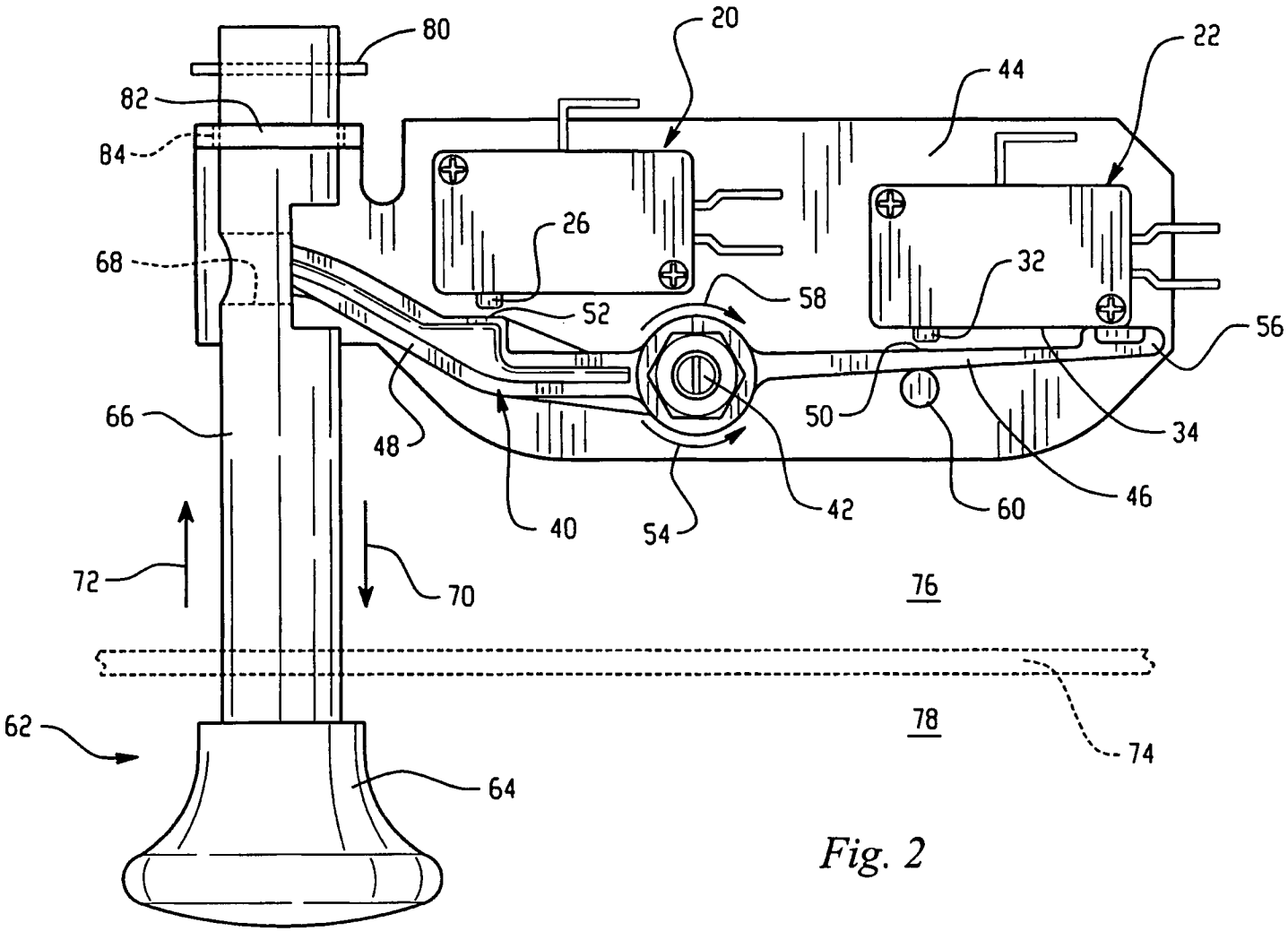
FIG. 2 is plan view of one embodiment of a multi-action switch assembly.
Figure 3:
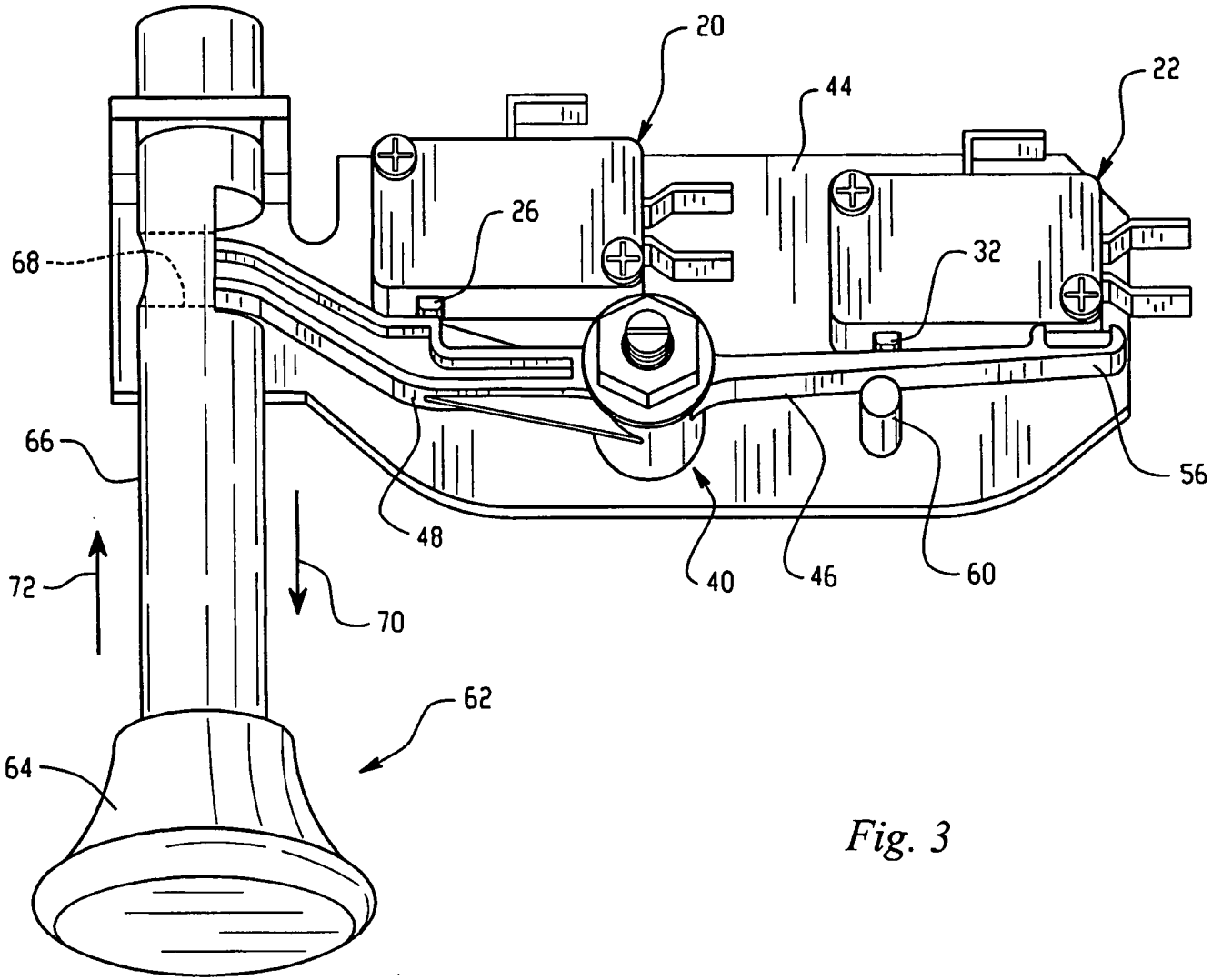
FIG. 3 is a perspective view of the switch assembly of FIG. 2.
Figure 4:
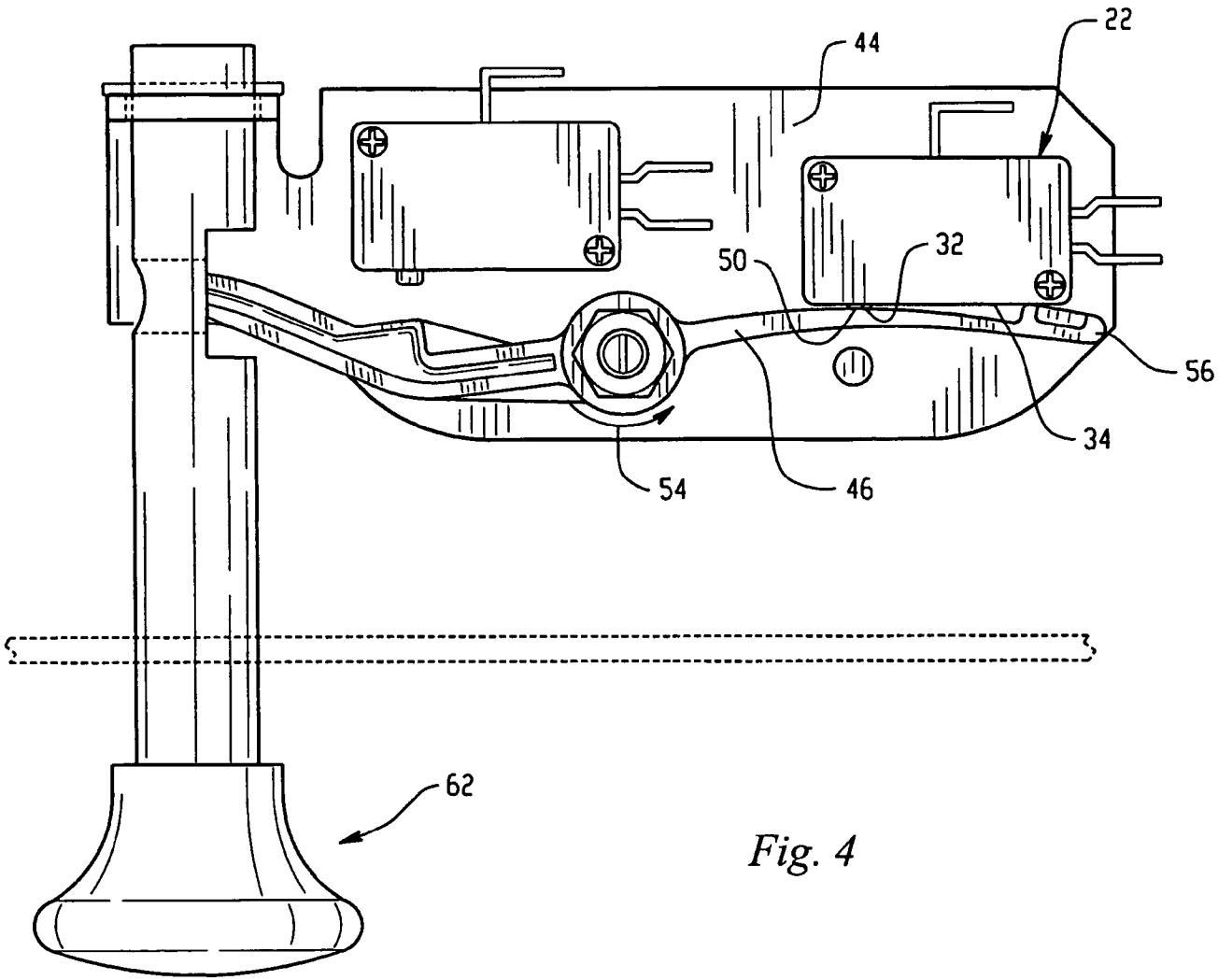
FIG. 4 is a plan view of the switch assembly of FIG. 2 with knob pulled outward.
Figure 5:
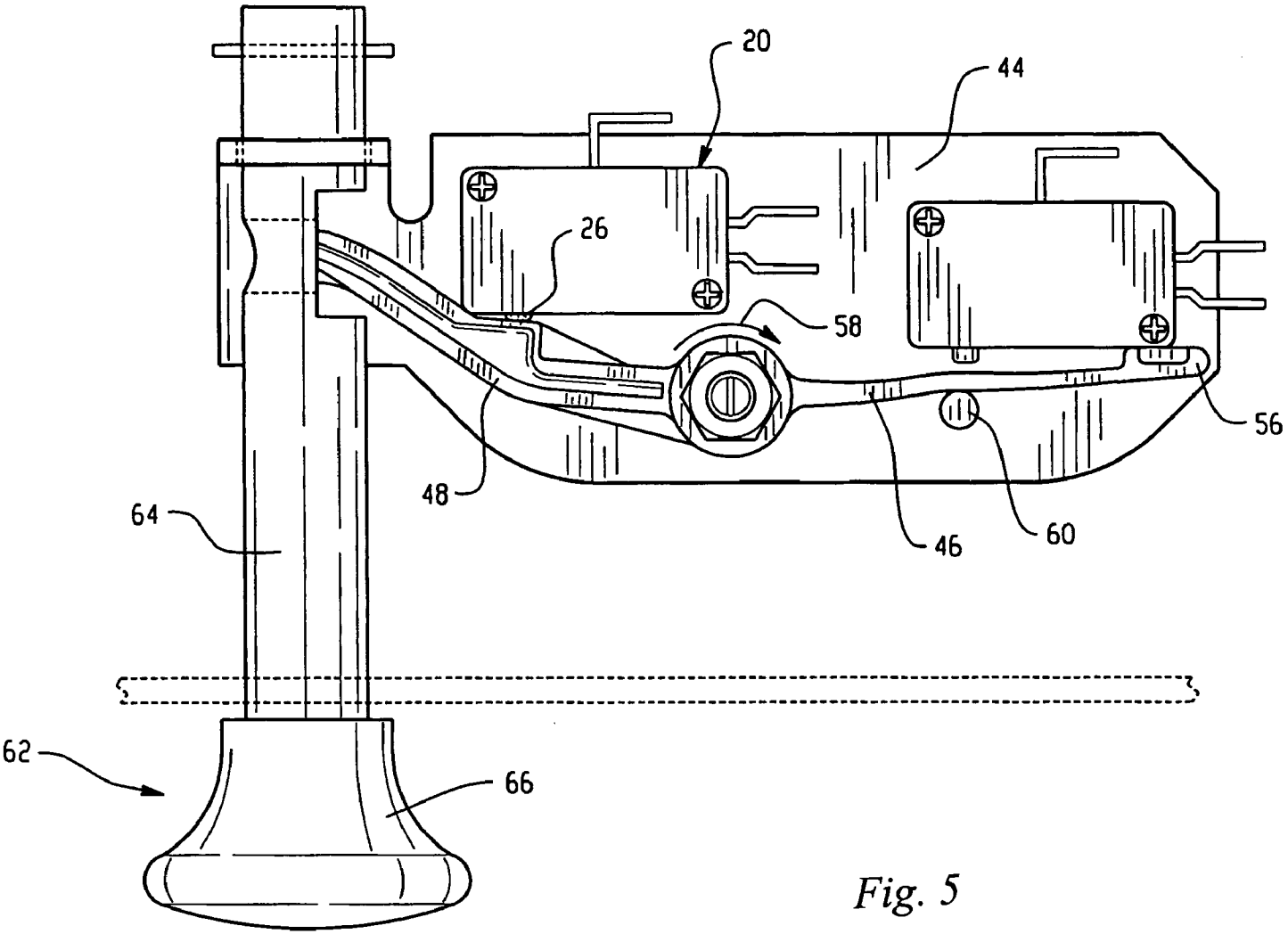
FIG. 5 is a plane view of the switch assembly of FIG. 2 with knob pushed inward.

In the illustrated embodiment, the actuator for switch units 20 and 22 also includes a push/pull knob 62 having a handle part 64 and a shaft part 66. The shaft part 66 includes a lateral opening 68 into which the end of arm 48 is positioned. When the push/pull knob 62 is moved in a direction 70, as by a person grasping the handle part 64 and pulling it, the push/pull knob applies a force to the end of arm 48 that causes the member 40 to pivot in direction 54. When the push/pull knob 62 is moved in a direction 72, as by a person pushing on the handle part 64, the push/pull knob 62 applies a force to the end of arm 48 that causes the member 40 to pivot in direction 58. Referring to FIG. 2, the illustrated multi-action switch assembly may be installed on a machine including a housing 74, with the plate 44, associated switch units 22, 24, pivot member 48 and one end of shaft part 66 on an internal side 76 of the housing 74, while one end of shaft part 66 extends to an external side 78 of the housing 74 where the handle part 64 is also located to facilitate appropriate actuation by a person. The plate 44 would normally be fixed in place as by screws or the like. The internal end of shaft part 66 may include a through pin 80 or other protrusion, such as a retaining ring, to limit movement of the push/pull knob in direction 70 upon engagement with a flange portion 82 of the plate 44, where the flange portion 82 includes an opening 84 through which the shaft part 66 extends. Movement of the push/pull knob 62 in the inward direction 70 may be limited by engagement of the handle part 64 with an exterior surface of the housing 74.

In an alternative embodiment, the switch unit 22 is positioned on a side of arm 48 opposite switch unit 20 and arm 48 includes a portion for contacting and moving the contact actuator 32 when member 40 is pivoted in direction 54. The end of arm 46 is positioned against a stop, such as a post extending up from the plate 44, to produce the flex in arm 46 when member 40 is pivoted in direction 54.

Figure 6:
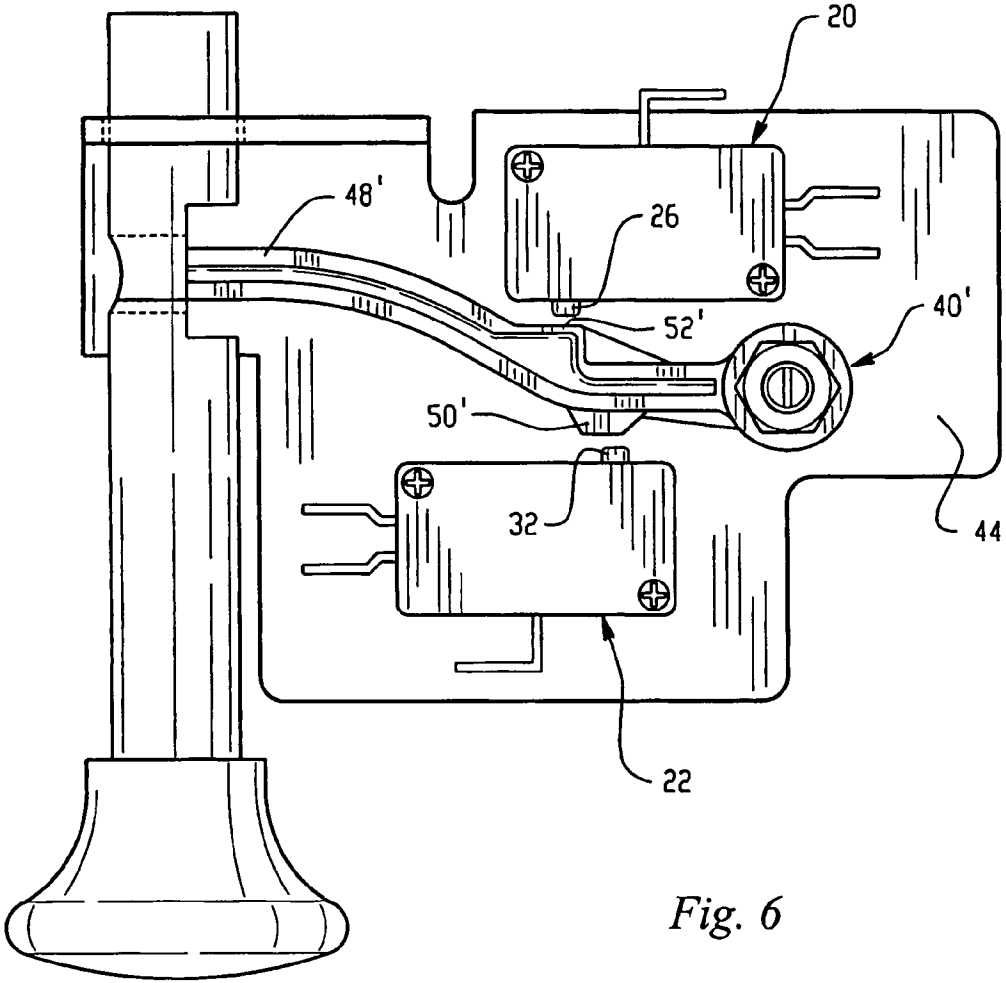
FIG. 6 is another alternative embodiment of a multi-action switch assembly.

In another alternative embodiment shown in FIG. 6, member 40' is rigidly fixed to the plate 44 to prevent pivot, but arm 48' of member 40' has a size, shape and material characteristic enabling it to flex sufficiently to enable portion 50' to engage contact actuator 32 and to enable portion 52' to engage contact actuator 26. The flex of the arm 48' always causes it to return to its illustrated normal position.

Figure 7:
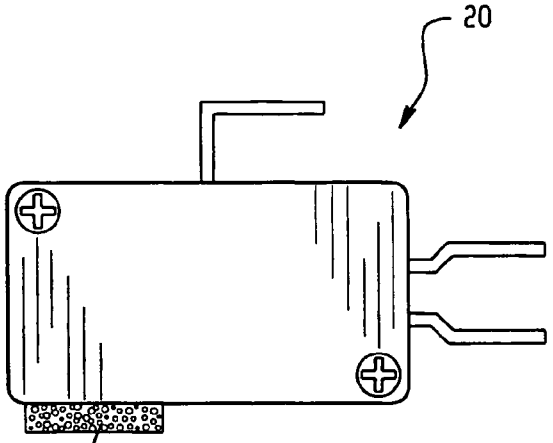
FIGS. 7 and 8 are side and bottom views, respectively, of an embodiment of a switch unit including a dampening pad.
Figure 8:
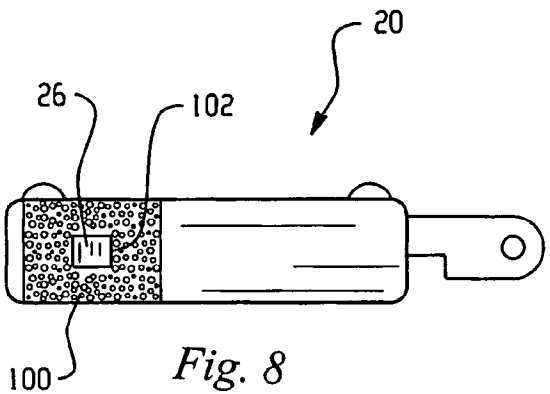

Referring now to FIGS. 7 and 8, switch unit 20 is shown in isolation and includes a dampening pad 100 (e.g., formed of compressible silicone foam). Referring particularly to FIG. 8, the dampening pad 100 includes an opening 102 through which contact actuator 26 extends. Due to the location of the dampening pad 100 between arm 48 and switch unit 20, the dampening pad 100 serves to dampen movement of the arm 48 (e.g., of FIGS. 2 and 6) when the arm is released, as an example. This can reduce the possibility of inadvertent switch unit actuation, e.g., as the arm 48 recovers to its normal position. Dampening pad 100, in some embodiments, can also apply a recovery force to the arm 48. This can lighten the tension requirements on the system, e.g., due to elevated operating temperatures. In some cases, switch unit 22 includes a dampening pad.

It is to be clearly understood that the above description is intended by way of illustration and example only and is not intended to be taken by way of limitation, and that changes and modifications are possible.

What is claimed is:

1. A power driven machine, comprising:

at least one energizable motor;

a control system for controlling motor operation and having an associated multi-action switch assembly including:

a first switch unit connected in the control system with an internal contact biased into a first condition, the first switch unit including an integrated contact actuator biased into a normal position and effective upon movement to transition the internal contact of the first switch unit to a second condition, wherein temporary transition of the internal contact of the first switch unit to the second condition controls a start operation of the motor;

a second switch unit connected in the control system with an internal contact biased into a first condition, the second switch unit including an integrated contact actuator biased into a normal position and effective upon movement to transition the internal contact of the second switch unit to a second condition, wherein temporary transition of the internal contact of the second switch unit to the second condition controls a stop operation of the motor;

a resilient switch actuator having a normal position in which the contact actuator of the first switch unit is in the normal position and the contact actuator of the second switch unit is in the normal position, when a first force is applied to bend the switch actuator in a first direction the switch actuator moves the contact actuator of the first switch unit out of the normal position, upon removal of the first force the switch actuator recovers toward the normal position and the contact actuator of the first switch unit returns to the normal position, when a second force is applied to bend the switch actuator in a second direction the switch actuator moves the contact actuator of the second switch unit out of the normal position, upon removal of the second force the switch actuator recovers toward the normal position and the contact actuator of the second switch unit returns to the normal position.

2. The machine of claim 1 wherein the resilient switch actuator comprises a pivot member mounted for pivot about a pivot axis, the first force is a pivoting force applied to pivot the pivot member in the first direction about the pivot axis, the second force is a pivoting force applied to pivot the pivot member in the second direction about the pivot axis.

3. The machine of claim 2 wherein the resilient switch actuator further comprises a push/pull knob connected to apply the first force to the pivot member when the push/pull knob is moved in a first direction and to apply the second force to the pivot member when the push/pull knob is moved in a second direction.

4. The machine of claim 3 wherein each of the first switch unit, the second switch unit and the pivot member are mounted to a common plate.

5. The machine of claim 4 wherein the common plate includes a flange portion having an opening therein, the push/pull knob includes a shaft part extending through the opening.

6. The machine of claim 5 comprising a retaining ring connected to the shaft part of the push/pull knob, the retaining ring having a dimension greater than a dimension of the opening to retain the shaft part in the opening.

7. The machine of claim 1 wherein when the first force is applied a portion of the resilient switch actuator bends in one direction and when the second force is applied a portion of the resilient switch actuator bends in another direction.

8. The machine of claim 7 wherein the resilient switch actuator comprises a pivot member including first and second arms, and the portion of the resilient switch actuator that bends is one of the first and second arms.

9. The machine of claim 8 wherein movement of the resilient switch actuator is restricted at one of the first and second arms of the pivot member.

10. The machine of claim 8 wherein the first arm engages the contact actuator of the first switch unit and the second arm engages the contact actuator of the second switch unit.

11. The machine of claim 1 wherein the machine comprises a food product slicer and the motor is connected for rotating a circular slicer knife of the food product slicer.

12. The machine of claim 1 wherein the machine comprises a band saw apparatus and the motor is connected to effect movement of a band saw blade.

13. The machine of claim 1 wherein the machine comprises a mixer and the motor is connected to effect movement of an output shaft of the mixer.

14. The machine of claim 1 wherein the first switch unit comprises a three terminal snap action microswitch and the second switch unit comprises a three terminal snap action micro switch.

15. The machine of claim 1 further comprising a dampening pad disposed between the resilient switch actuator and the first switch unit for dampening the movement of the resilient switch actuator as the resilient switch actuator engages the contact actuator.

16. A power driven machine, comprising:

at least one energizable motor;

a control system for controlling motor operation and having an associated a multi-action switch assembly including:

a first switch unit connected in the control system with an internal contact in a first condition, the first switch unit including an integrated contact actuator effective upon movement to transition the internal contact of the first switch unit to a second condition, wherein transition of the internal contact of the first switch unit to the second condition controls a start operation of the motor;

a second switch unit connected in the control system with an internal contact in a first condition, the second switch unit including an integrated contact actuator effective upon movement to transition the internal contact of the second switch unit to a second condition, wherein transition of the internal contact of the second switch unit to the second condition controls a stop operation of the motor;

a switch actuator including a pivot member mounted for pivot about a pivot axis, the pivot member having a normal position relative to the pivot axis in which the contact actuator of the first switch unit is in an established position, the internal contact of the first switch unit is in the first condition, the contact actuator of the second switch unit is in an established position, and the internal contact of the second switch unit is in the first condition, when a first pivoting force is applied to move the pivot member in a first direction a first portion of the pivot member moves the contact actuator of the first switch unit out of the established position to transition the internal contact of the first switch unit to the second condition, when a second pivoting force is applied to move the pivot member in a second direction a second portion of the pivot member moves the contact actuator of the second switch unit out of the established position to transition the internal contact of the second switch unit to the second condition.

17. The machine of claim 16 wherein during application of the first pivoting force movement of part of the pivot member is restricted such that the part flexes and causes the pivot member to return to the normal position when the first pivoting force is removed, and during application of the second pivoting force movement of part of the pivot member is restricted such that the pivot member flexes and causes the pivot member to return to the normal position when the second pivoting force is removed.

18. The machine of claim 16 wherein the machine comprises a food product slicer and the motor is connected for rotating a circular slicer knife of the food product slicer.

19. The machine of claim 16 wherein the machine comprises a band saw apparatus and the motor is connected to effect movement of a band saw blade.

20. The machine of claim 16 wherein the machine comprises a mixer and the motor is connected to effect movement of an output shaft of the mixer.

21. A multi-action switch assembly, comprising:

a first switch unit with an internal contact movable between a first condition and a second condition;

a second switch unit with an internal movable between a first condition and a second condition; and a resilient switch actuator having a normal position in which the internal contact of the first switch unit is in its first condition and the internal contact of the second switch unit is in its first condition, when a first force is applied to bend the switch actuator in a first direction the switch actuator causes the internal contact of the first switch unit to transition to the second condition, upon removal of the first force the switch actuator recovers toward the normal position and the internal contact of the first switch unit returns to the first condition, when a second force is applied to bend the switch actuator in a second direction the switch actuator causes the internal contact of the second switch unit to transition to the second condition, upon removal of the second force the switch actuator recovers toward the normal position and the internal contact of the second switch unit returns to the first condition.

22. The switch assembly of claim 21 wherein the switch actuator comprises a pivot member mounted for pivot about a pivot axis, the first force is a pivoting force applied to pivot the pivot member in the first direction about the pivot axis, the second force is a pivoting force applied to pivot the pivot member in the second direction about the pivot axis.

23. A power driven machine comprising:

at least one energizable motor; and a control system for controlling the motor, the control system including the switch assembly of claim 21.

* * * * *

UNITED STATES PATENT AND TRADEMARK OFFICE

CERTIFICATE OF CORRECTION

PATENT NO. : 6,998,557 B2
DATED : February 14, 2006
INVENTOR(S) : McGuffin-Noll

It is certified that error appears in the above-identified patent and that said Letters Patent is hereby corrected as shown below:

Column 7,
Line 35, change “micro switch” to -- microswitch --.
Line 44, delete “a” after “associated”.

Column 8,
Lines 40 and 41, change “its” to -- the --.

Signed and Sealed this

Eighteenth Day of April, 2006

JON W. DUDAS
*Director of the United States Patent and Trademark Office*